US007717291B2

(12) United States Patent
Stuhmer

(10) Patent No.: US 7,717,291 B2
(45) Date of Patent: May 18, 2010

(54) ACCURATE SQUIRT DISPENSING DRINK BOTTLE ADAPTER

(76) Inventor: Wilco Stuhmer, 2516 Chadwick St., Salt Lake City, UT (US) 84106

( * ) Notice: Subject to any disclaimer, the term of this patent is extended or adjusted under 35 U.S.C. 154(b) by 1123 days.

(21) Appl. No.: 11/317,459

(22) Filed: Dec. 22, 2005

(65) Prior Publication Data

US 2007/0145083 A1 Jun. 28, 2007

(51) Int. Cl.

| | |
|---|---|
| ***B65D 5/74*** | (2006.01) |
| ***B65D 35/38*** | (2006.01) |
| ***B65D 35/52*** | (2006.01) |
| *B65D 25/44* | (2006.01) |
| *B65D 25/46* | (2006.01) |

(52) U.S. Cl. ..... 220/714; 220/203.17; 220/256.1; 220/717; 220/718; 215/387; 222/567; 222/570

(58) Field of Classification Search ..... 220/716, 220/703, 709, 717, 718, 714, 203.17, 256.1; 222/567, 570; 215/387, 388; D7/316
See application file for complete search history.

(56) References Cited

U.S. PATENT DOCUMENTS

| | | | | | |
|---|---|---|---|---|---|
| 2,155,049 | A | * | 4/1939 | Isaacson | 220/717 |
| 2,678,142 | A | * | 5/1954 | Creed | 220/717 |
| 2,767,744 | A | * | 10/1956 | Beerman | 141/319 |
| 4,183,328 | A | | 1/1980 | Lawrence | |
| 4,264,022 | A | * | 4/1981 | Perne et al. | 222/547 |
| 4,332,250 | A | | 6/1982 | Behney | |
| 4,718,778 | A | | 1/1988 | Ichikawa | |
| 4,759,453 | A | | 7/1988 | Paetzold | |
| 4,775,060 | A | | 10/1988 | Pinney | |
| 4,938,395 | A | | 7/1990 | Jamieson | |
| 4,951,839 | A | * | 8/1990 | Kong | 222/47 |
| 5,085,330 | A | | 2/1992 | Paulin | |
| 5,221,027 | A | | 6/1993 | Gibilsco | |
| 5,236,415 | A | | 8/1993 | Stallings | |
| 5,362,561 | A | | 11/1994 | Lower | |
| 5,433,353 | A | | 7/1995 | Flinn | |
| 5,454,489 | A | | 10/1995 | Vesborg | |
| 5,467,888 | A | * | 11/1995 | Brandstrom et al. | 220/319 |
| 5,474,541 | A | | 12/1995 | Ritsky et al. | |
| 5,518,143 | A | | 5/1996 | Iodice | |
| 5,632,407 | A | | 5/1997 | Christensen | |
| 5,762,120 | A | | 6/1998 | Smith | |
| 5,809,935 | A | | 9/1998 | Kolterman et al. | |

(Continued)

OTHER PUBLICATIONS

"Lil; Topper" www.liltopper.com/how.htm Oct. 31, 2005, pp. 1-3.

*Primary Examiner*—Anthony Stashick
*Assistant Examiner*—Niki M Eloshway
(74) *Attorney, Agent, or Firm*—Kirton & McConkie; William T. Ralston

(57) ABSTRACT

A bottle adapter is disclosed for accurate squirt dispensing of a drink. The bottle adapter comprises a coupler for removable attachment to a squeezable bottle. The coupler has a valve that is configured to remain closed until a predefined pressure difference is present across the valve, so that when the valve is opened, the liquid inside the container emerges in a stream and maintains a substantially straight trajectory for at least a predefined distance. A targeting orifice is positioned at the predefined distance from the valve so that the stream trajectory extends through the targeting orifice.

23 Claims, 6 Drawing Sheets

U.S. PATENT DOCUMENTS 5,823,384 A * 10/1998 Sartori de Zamparolo ... 220/717
5,826,356 A 10/1998 Lapp
5,947,324 A 9/1999 Palinchak
5,971,222 A 10/1999 Caldwell
5,992,662 A * 11/1999 Holt et al. ..... 215/395
6,117,319 A 9/2000 Cranshaw
6,129,291 A 10/2000 Commeville
6,209,737 B1 4/2001 Bliss
6,311,864 B1 * 11/2001 Land ..... 220/737
6,470,609 B1 10/2002 Dannenbaum
D470,050 S 2/2003 Renz et al.
6,565,899 B1 5/2003 Cecere
6,705,485 B1 * 3/2004 Sato et al. ..... 220/713
6,739,484 B2 5/2004 Finley
6,750,943 B2 6/2004 Pearlman et al.
6,848,628 B2 2/2005 Walker
6,919,025 B2 7/2005 Cluff et al.
7,350,666 B2 * 4/2008 Essebaggers ..... 220/714
2003/0029829 A1 2/2003 Stephan
2004/0116036 A1 6/2004 Nugent et al.
2004/0140315 A1 7/2004 Reinoso

* cited by examiner

ACCURATE SQUIRT DISPENSING DRINK BOTTLE ADAPTER

FIELD OF THE INVENTION

The present invention relates generally to improvements in squeezable drink containers. More particularly, the present invention relates to an adapter attachable to a drink container for providing accurate squirt drink dispensing from a squeezable drink container.

BACKGROUND

Squeezable drink containers are frequently used by individuals participating in recreational and athletic events, who want to avoid the hassle of removing and replacing a lid or cap. To serve this purpose, various dispensing systems have been developed, including pop tops, pivotal or retractable assemblies, or twist-open tops. The container is then squeezed to dispense the contents in a stream which is aimed into the mouth of the user. These dispensing systems can dribble or leak from their respective pivoting, retracting, or attaching assemblies when overturned. These dispensing systems also have a risk of being misaimed, which can cause the drink to hit the user in the face or spill onto their clothing. Accordingly, the use of these dispensing systems has primarily been limited to those participating in sports and recreational activities. Squirt dispensing has had little appeal for adults in the home, work, school, party, and other social settings.

Drink containers with a variety of no-spill or low-spill-risk dispensing systems are available and marketed for use by infants and young children. Various approaches have been adopted to make these containers appealing for use by children. Accordingly, they have not been viewed as suitable for use by adults. Young children like to imitate adults, and thus sometimes wish to use a squirt bottle when they see their parents do so. Squirt-type dispensing is generally not suitable for young children who lack the dexterity to properly aim the squirt bottle.

SUMMARY

Accordingly, it has been recognized by the present inventor that it would be desirable to have a fun and interactive way of dispensing a drink that is suitable and appealing for both children and adults, while providing an attendant low risk of spills.

In one embodiment, the present invention includes a bottle adapter providing an accurate way to squirt dispense a drink from a squeezable drink container. The bottle adapter includes a coupler configured for removable attachment to a squeezable container. Disposed within the coupler is a valve, configured to remain closed until a predefined pressure difference is present across the valve. When the valve is opened, a liquid within the squeezable drink container emerges in a stream and maintains a substantially straight trajectory over at least a predefined distance. A targeting orifice is positioned the predefined distance from the valve and oriented so the stream trajectory extends through the targeting orifice.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

DETAILED DESCRIPTION OF EXAMPLE EMBODIMENTS

Reference will now be made to the exemplary embodiments illustrated, and specific language will be used herein to describe the same. It will nevertheless be understood that no limitation of the scope of the invention is thereby intended.

Figure 1:
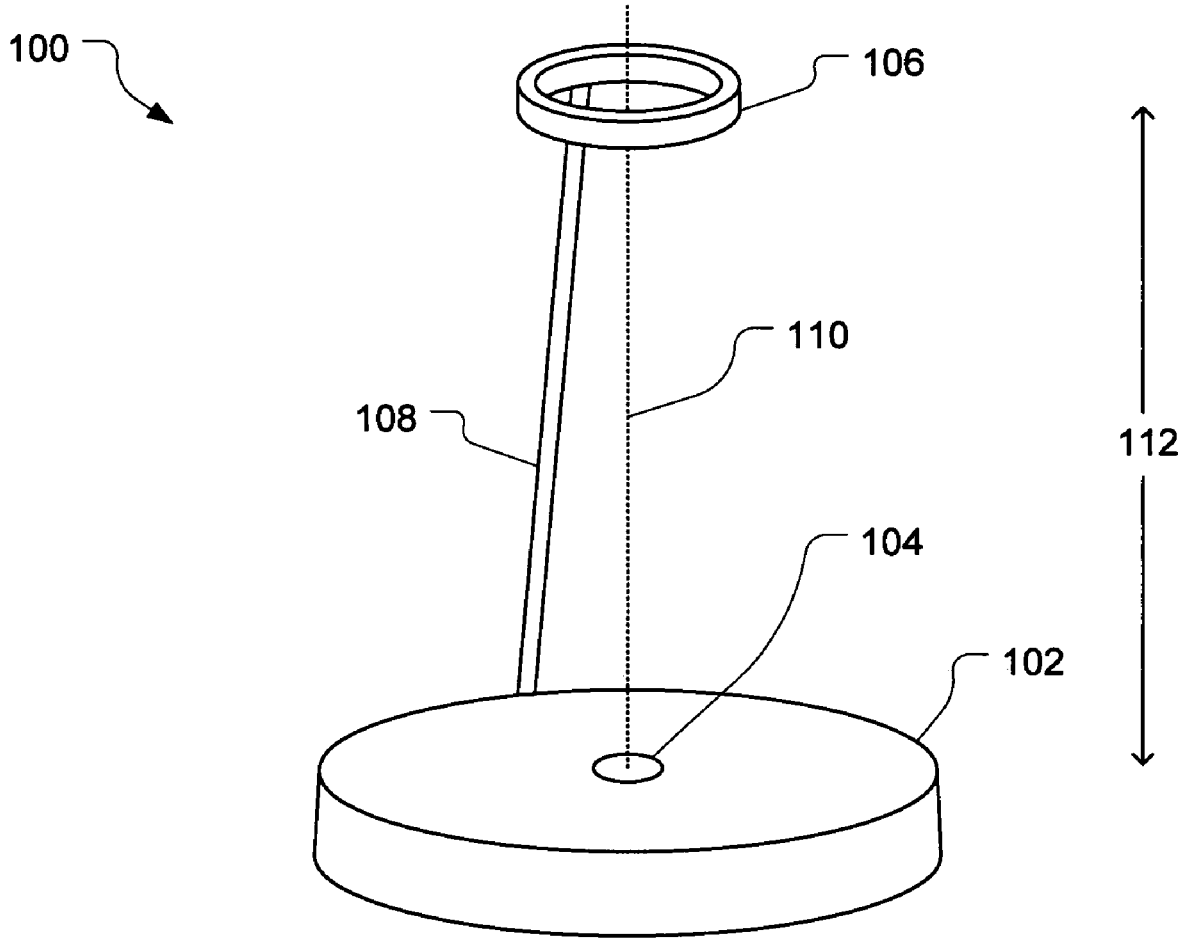
FIG. 1 is a perspective view of a bottle adapter in accordance with an embodiment of the present invention.

In accordance with FIG. 1, a bottle adapter 100 in one exemplary embodiment of the present invention includes a coupler 102 configured to be removably attached to a squeezable drink container. The coupler includes a valve 104, configured to squirt a stream of liquid through a targeting orifice 106 during use. The targeting orifice is positioned a predefined distance 112 from the valve, for example via a riser 108. The targeting orifice is thus positioned so that, when fluid is dispensed from the container, it passes through the targeting orifice as will now be explained.

Figure 2:
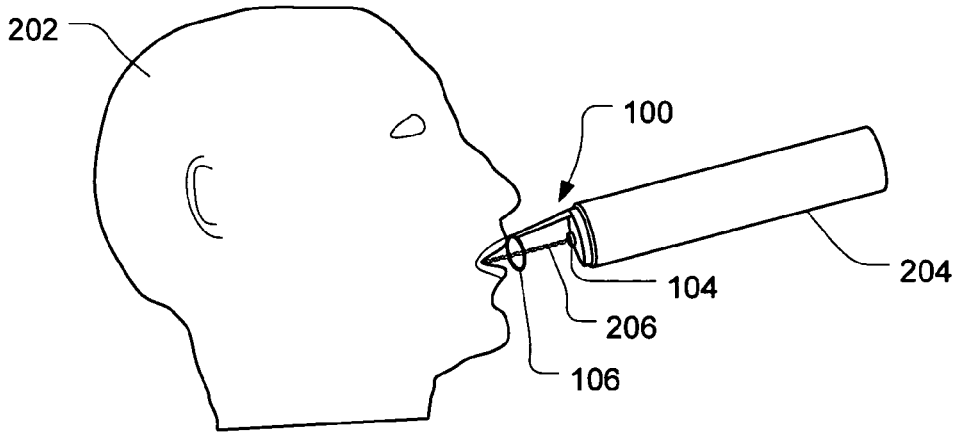
FIG. 2 is an illustration of a squeezable drink container with the bottle adapter of the invention during drinking by a user.

FIG. 2 illustrates use of a bottle adapter in accordance with an embodiment of the present invention. The bottle adapter 100 is attached to a squeezable drink container 204, which contains a drinkable liquid (including for example, water, fruit drink, soda, iced tea, beer, and the like, referred to generally herein as a beverage). When a user 202 desires to consume the liquid in the container, the user squeezes the container after positioning the user's mouth around or near the targeting orifice 106. When the applied pressure in the container causes the pressure difference across the valve 104 to equal or exceed the predefined pressure difference, the valve opens, squirting a stream 206 of liquid into the mouth of the user.

The valve 104 remains closed until the predefined pressure difference is present across the valve. In other words, when the pressure inside the squeezable drink container 204 exceeds the pressure outside the container by the predefined pressure difference or more, the valve opens. This helps to ensure that, when the bottle is squeezed, sufficient pressure is present propelling the stream 206 so that the stream that emerges will maintain a substantially straight trajectory 110 up to at least a predefined distance 112, causing the stream to pass through the targeting orifice 106. As used herein, substantially straight means that the trajectory is nearly straight. As will be appreciated by one of skill in the art, the trajectory can be slightly curved, for example, due to the effect of gravity on the stream. Accordingly, some variation from being perfectly straight can be accommodated, depending on the size of the targeting orifice. The predefined pressure difference of the valve and the size and predefined distance of the targeting orifice are designed so the stream will pass through the orifice substantially independently of the orientation of the drink container as will be explained further below.

Various benefits are provided by the bottle adapter 100. Because the valve 104 does not open without a pressure differential, the risk of spills is reduced. The targeting orifice 106 provides a clear location for the user to position his or her mouth to receive the stream. This helps to avoid aiming errors and makes the bottle more suitable for use in a variety of settings. For example, children who would have difficulty aiming a conventional squirt bottle can be able to use a squirt bottle with the bottle adapter attached. Additionally, adults who have avoided the use of squirt bottles due to the risks of spills and misaiming may be more willing to use a squirt bottle with the bottle adapter.

The predefined distance 112 is correlated with the predefined pressure difference required to open the valve 104. The predefined distance can thus be set to different values by adjusting the predefined pressure difference of the valve. In general, a valve with a higher value of predefined pressure difference enables the distance between the valve and the targeting orifice to be proportionally larger, other factors being held constant. Of course, other characteristics of the valve, such as the valve opening size, can also affect the predefined distance. The predefined distance can also be affected by the fluid properties of the liquid, including, for example, viscosity, specific gravity, and surface tension. In general, a more viscous liquid will provide a smaller predefined distance, other factors being held constant.

The predefined distance 112 can generally be set within a range of about 1 to 4 inches, although smaller or larger predefined distances may be possible. For example, the predefined distance can be set to approximately 3-4 inches using a silicone slit valve having an opening of approximately 1/16 inch across when the valve is open. One example of a silicone valve is manufactured by Seaquist Closures, Mukwonago, Wis., under the name "SimpliSqueeze valve."

When the predefined distance 112 is set to approximately 3-4 inches, the pressure difference associated with this separation can provide an exciting effect when the stream 206 contacts the tongue of the user 202. This effect is particularly enhanced when a carbonated beverage is used. As another example, the targeting orifice can be positioned so that the stream largely bypasses the tongue and directly hits the throat and/or tonsils to provide even more effective thirst quenching. For example, decorative elements, as described below, can be positioned on the targeting orifice to give a sense of front and back to the bottle adapter to help position the user's mouth in a predictable orientation.

The bottle adapter 100 is suitable for use with a wide variety of beverages. For example, the bottle adapter can provide an enhanced beer-drinking experience by creating additional foam when the beer strikes the inside of the user's mouth, providing additional head after the point at which beer would ordinarily go flat. When intended for use with a carbonated beverage, the predefined pressure difference of the valve 104 may be increased to reduce the potential that pressure due to the carbonation causes the valve to open prematurely.

The bottle adapter 100 can also be used with somewhat viscous beverages, such as orange juice or yoghurt. When intended for use with viscous beverages, the characteristics of the valve 104, such as the valve opening size or predefined pressure difference can be adjusted, the targeting orifice size can be adjusted, or the predefined distance 112 can be set differently, as noted above. One interesting effect achieved with viscous beverages is a tendency for the emerging stream to form droplets which cause a pulsing effect when the stream hits the inside of the user's mouth. This effect is particularly pronounced when the stream contacts the back of the throat.

Figure 6:
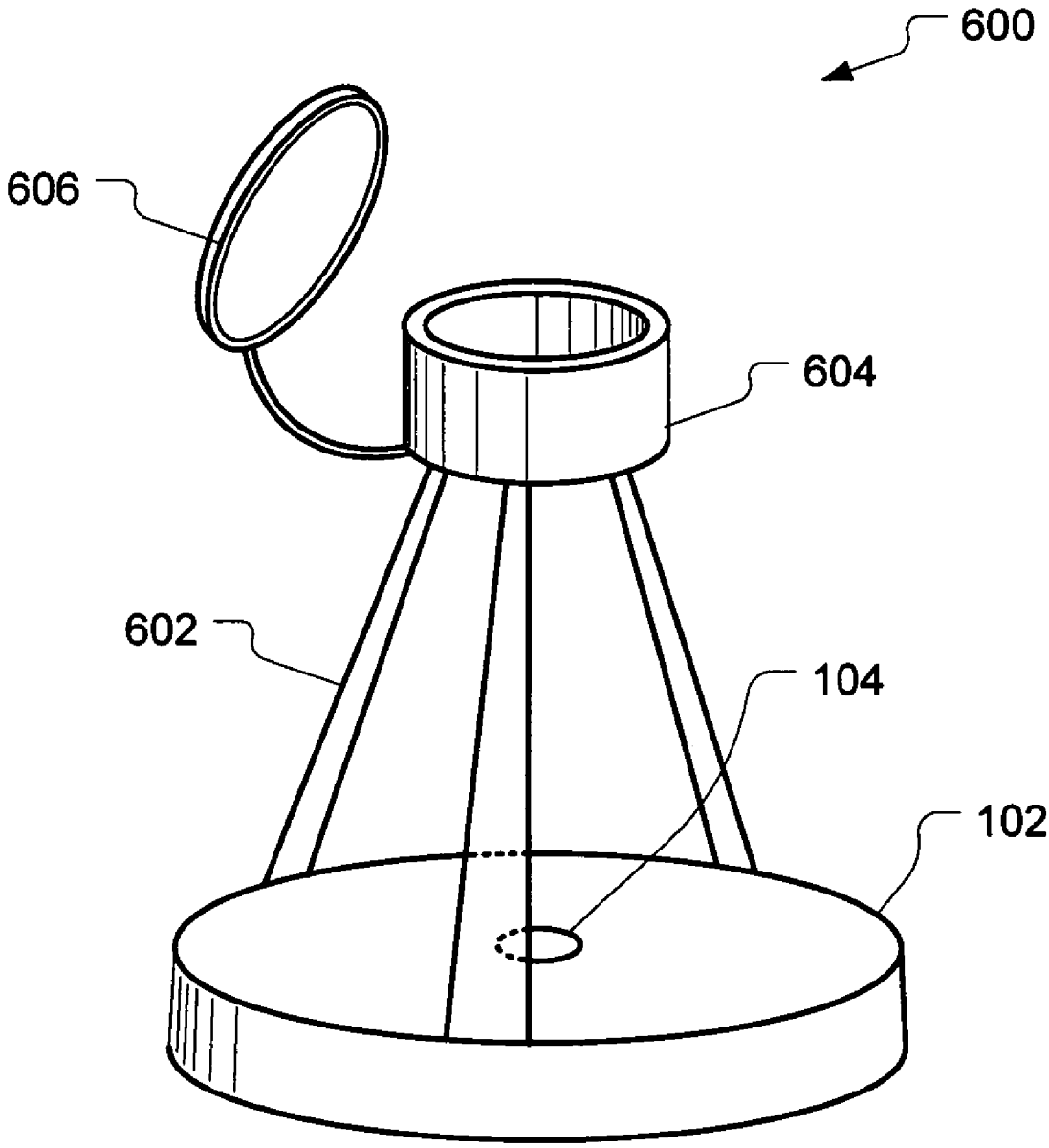
FIG. 6 is a perspective view of a bottle adapter having multiple risers and a cap according to an alternate embodiment of the present invention.

Various alternate configurations of a bottle adapter can be used in accordance with embodiments of the present invention. For example, multiple risers 602 can be included as illustrated in FIG. 6, providing a partially enclosed structure between the targeting orifice 604 and the valve 104. The multiple risers can include two-dimensional rigid or flexible designs, or the multiple risers can form a three-dimensional design. By providing a generally open area between the valve and the targeting orifice, the user 202 is allowed an open view of the expelled liquid stream 206. This can help create a perception of risk that there will be spillage, creating excitement for the user. Because the targeting orifice 106 is set at a predefined distance 112 as determined by the valve 104 characteristics, the liquid stream will consistently pass through the targeting orifice 106, helping to avoid such risks.

The stream 206 is controlled by the valve 104 to help ensure it passes through the targeting orifice 106 independent of the orientation of the squeezable drink container 204. Of course, one of skill in the art will appreciate that no stream will emerge unless the container is oriented in a position where the contents can access the valve. For example, one mode of operation is to tilt the container to an approximately horizontal orientation so as to cause the liquid to move against the valve. The container can also be tilted past horizontal, for example, as illustrated in FIG. 2, or even completely inverted. In an alternate mode of operation, the valve can be coupled to an internal straw within the container to allow operation in a substantially upright vertical orientation.

The position of the stream 206 will be affected somewhat by gravity, but the valve 104 pressure difference helps to ensure that the stream maintains a substantially straight trajectory 110 over the predefined distance 112. Hence, the targeting orifice 106 can be positioned and sized so that the stream passes through the targeting orifice regardless of the orientation of the squeezable drink container 204. For example, slight variations in the position of the stream that depend on the orientation of the bottle can be accommodated by the size of the targeting orifice selected. More particularly, a targeting orifice of 1 inch (inside) diameter has proven suitable with some silicon slit valves when positioned approximately 3 inches from the valve. Longer predefined distances can be accommodated for a given valve configuration by providing correspondingly larger targeting orifice diameters. Accordingly, one of skill in the art will appreciate that many different combinations of valve predefined pressure difference, valve opening size, targeting orifice diameter, and predefined distance can be used in embodiments of the present invention.

Various ways of constructing a bottle adapter in accordance with embodiments of the present invention are possible. The coupler 102 can be made of food grade plastic, and can be made to couple to a variety of squeezable drink container sizes. The coupler may attach to a squeezable drink container 204 by means of a screw-on type system, snap-on system, or other removable attachment known in the art. For example, the coupler can include internal threads for screwing onto a threaded top of the squeezable drink container. As another example, the coupler can be configured to snap onto the top of a squeezable drink container, for example forming a friction fit. Optionally, the coupler may include an o-ring or similar structure to enhance sealing between the coupler and the squeezable drink container to help prevent leakage.

The valve 104 can be a check valve, by which is meant a valve which requires a pressure difference in order to open. This pressure difference required to open the valve is referred to as cracking pressure. The valve can be a one way check valve, a silicone slit type check valve, or similar. The slit of the valve may be a single slit or a cross slit. Various other types of valves which require a pressure difference to open will occur to one of skill in the art which may prove suitable for use in embodiments of the present invention.

The targeting orifice and riser can also be made of food grade plastic. Although shown in the form of a ring, the targeting orifice can take on a variety of shapes including by way of example and not limitation, a rectangle, triangle, heart, symbol, letter, or other shape which has an open orifice positioned to receive the liquid stream. The targeting orifice can also be in the form of a tube 604 extending along the trajectory of the stream, as illustrated in FIG. 6. For example, the top of the tube can be positioned at the predefined distance and the bottom extends generally towards the valve. A tube or generally extended targeting orifice can help to prevent splattering which can occur when long predefined distance is used or when nearing the end of a beverage where a mixture of air and beverage is expelled from the valve, either situation resulting a loss of coherence in the stream. Risers 602 can attach to the tube at the top, bottom, or in between.

The coupler, targeting orifice, and riser can be transparent, translucent, and/or opaque, and can individually include one or more colored, fluorescent, and/or glow in the dark effects. For example, a glow in the dark targeting orifice can aid the user in properly positioning their mouth in low-light or dark conditions. The targeting orifice can be integrally formed with the riser, or can be separate assemblies coupled together.

The riser 108 is sufficiently rigid or resilient as to maintain the targeting orifice 106 in proper position. It will be appreciated that the riser need not be perfectly rigid, as some movement in the position of the targeting orifice 106 can be permitted. For example, if the position of the stream in the plane of the targeting orifice is controlled to within approximately ¼ inch tolerance (e.g., as the bottle orientation is varied) and the targeting orifice has a diameter of approximately 1 inch, then approximately ¼ inch tolerance in the lateral positioning of the targeting orifice can be allowed. Accordingly, a less rigid riser can be accommodated with a larger targeting orifice.

The length of the riser 108 is determined, in part, by the predefined distance 112, which is a function of the characteristics of the valve 104 as discussed above. In order to create a more decorative, entertaining bottle topper, the riser or risers can be of various two- and three-dimensional decorative shapes and configurations.

Figure 3A:
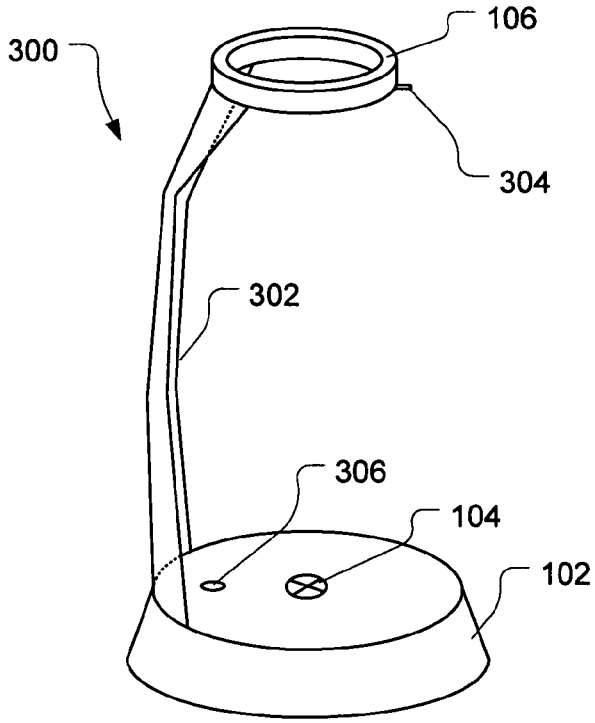
FIGS. 3*a* and 3*b* are perspective views of a bottle adapter with a locking element in accordance with an alternate embodiment of the present invention.
Figure 3B:
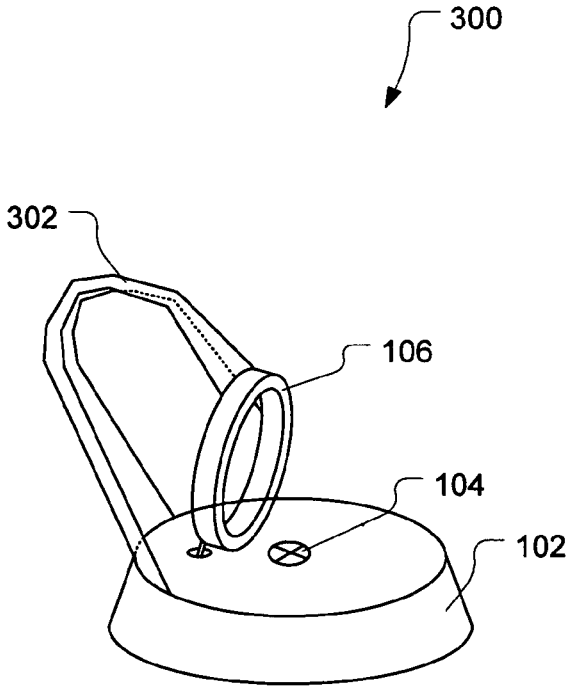

Illustrated in FIGS. 3*a* and 3*b*, is a bottle adapter in accordance with another embodiment of the invention. The bottle adapter 300 includes a coupler 102 which has a valve 104 disposed therein. A targeting orifice 106 is connected to the coupler via a flexible riser 302, which holds the targeting orifice in position to receive a stream of liquid, while being capable multi-directional movement, including being bent down to a locking position (as shown in FIG. 3*b*). The targeting orifice includes a first locking element, which holds the targeting orifice in a collapsed position when inserted into a second locking element disposed on the coupler. Although the first locking element and second locking elements are shown here as a pin 304 which engages with a recess 306 in the adapter, various other embodiments of the first and second locking elements are possible. For example, the locking elements can be provided by a ring and hook, pin and hole, tab and slot, etc. As another example, the first locking element can be the nose, hand or other protruding feature of a cartoon character disposed on or integrated with the targeting orifice which engages with a second locking element provided by an appropriate feature on the adapter or the riser itself. The engagement of the first and second locking elements may be of a variety of means, including, but not limited to, a snap-in correlation or means whereby the first locking element is held in the second locking element by the pressure of the flexible riser. In order to provide an interactive and fun embodiment, the locking means may also be configured so it can be disengaged by a simple flick-of-the-wrist, or by more intentional means such as unclipping the first locking element from the second locking element, or the pressing of a trigger or button.

Benefits of the flexible riser 302 are provided. For example, the flexible riser provides a shock absorbing characteristic helping to reduce the chance of discomfort or injury if the bottle adapter abruptly contacts the user's lips or mouth. Another benefit of the flexible riser is that the overall height can be reduced, making storage of a bottle with the bottle adapter attached easier.

Figure 4:
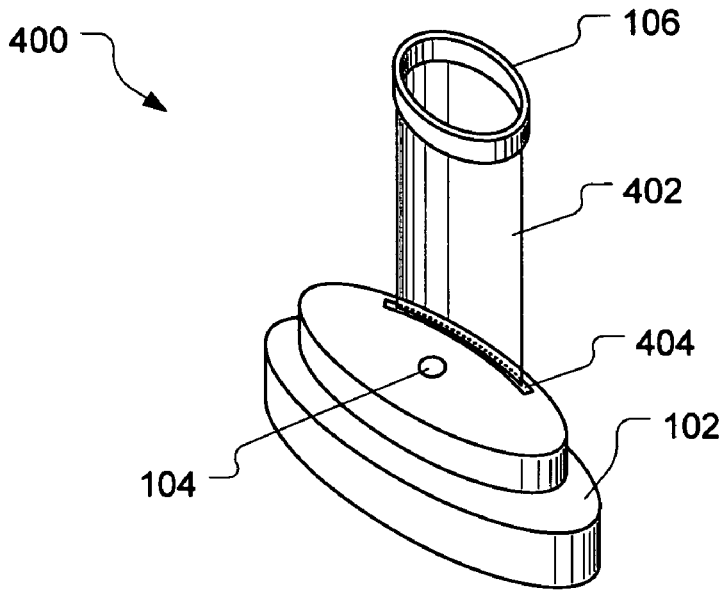
FIG. 4 is a perspective view of a bottle adapter with a collapsible riser in accordance with an alternate embodiment of the present invention.

In accordance with FIG. 4, a bottle adapter 400 of another embodiment of the invention is illustrated. Operation of the bottle adapter is similar to the previously discussed embodiments. Here, the targeting orifice 106 is mechanically connected to the coupler 102 via a collapsible riser 402, configured to slide into a riser cavity 404 of the coupler. Alternate arrangements include where the collapsible riser is a telescoping riser that extends and retracts into the riser cavity. The collapsible riser allows the overall profile of the bottle adapter to be reduced when not in use.

Figure 5:
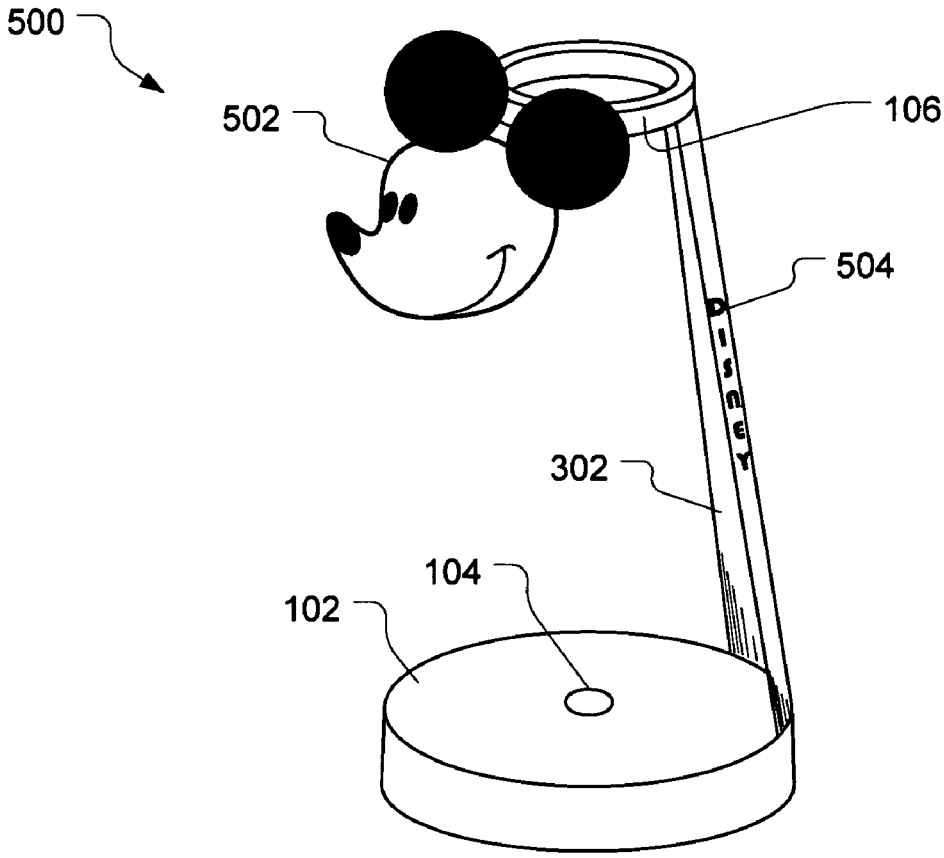
FIG. 5 is a perspective view of the bottle adapter with promotional features according to an alternate embodiment of the present invention.

A bottle adapter 500 can include promotional features as illustrated in FIG. 5 in accordance with another embodiment of the present invention. Promotional features can be included which will appeal to children, teenagers, or adults. Features can be included to appeal to collectors, sports fans, or hobbyists. Promotional features can serve to advertise products, services and the like, or promotional features can simply serve as decorative elements. A potential benefit is that decorative features can increase the appeal of a product dispensed with the bottle adapter or provide a psychological perception of improved taste. For example, a decorative feature 502 may be an image, such as a representation of an animal, animation character, cartoon character, celebrity, politician, caricature, and the like. For example, a decorative representation can appeal to a specific crowd or group. As an example, milk may be dispensed using a bottle adapter which includes a cow character.

Figure 7:
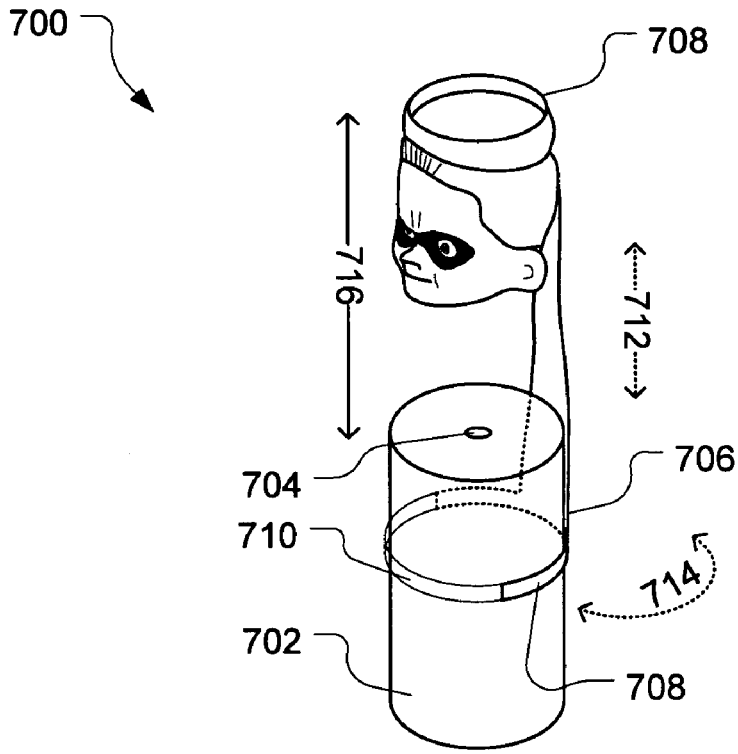
FIG. 7 is a perspective view of a bottle adapter for use with a squeezable drink container where the squeezable drink container includes a valve in accordance with another embodiment of the present invention.

A promotional or decorative feature 502 can be placed on or around the targeting orifice. For example, a two- or three-dimensional cartoon character head can be disposed on the targeting orifice. Alternately, the targeting orifice can be a three-dimensional cartoon character head having an appropriate aperture, for example as illustrated in FIG. 7. When a head is combined with a flexible riser, this can produce a bobble-head effect. Alternately, the decorative feature can be a full body figure, including, for example, different body poses, clothing, etc. As another example, the decorative feature may be something other than an image, for example, a basketball net.

A further promotional or decorative feature 504 may include artwork on the riser, coupler or targeting orifice. This artwork combined with the decorative features 502, or a plurality of decorative features may give the bottle adapter 500 a theme or motif. Glow-in-the-dark colored artwork and/or decorative features may be applied to increase appeal, for example, for night club usage. A hovering effect can be produced by using a transparent riser and a glow-in-the-dark targeting orifice (or glow-in-the-dark elements disposed on or integral with the targeting orifice). Optionally, interesting colored drinks or even glow in the dark colored drink (if and when available) may be combined with interesting shaped containers and embodiments of the present invention to provide new appeal for drink dispensing in a club or discotheque. Various combinations of color, glow in the dark, and optical effects can be used for the decorative features. Other decorative features known in the art may be applied to increase appeal to particular groups in particular settings.

FIG. 6 illustrates another embodiment of a bottle adapter 600 in accordance with an embodiment of the invention. The bottle adapter includes multiple risers 602 supporting a tubular targeting orifice 604. Multiple risers can help to provide additional rigidity to the targeting orifice, while retaining an open appearance to enhance the visual risk aspect of the bottle adapter as discussed above. The tubular targeting orifice can help to avoid errant spray caused by air being aspirated into the stream as described above. The bottle adapter also includes a cap 606, for example, snapping onto the targeting orifice. The cap can help to prevent contamination of the targeting orifice by covering it when not in use. As another embodiment, a cap can be configured to snap onto the coupler, covering the targeting orifice and riser, for example when the riser is in a collapsed configuration. Optionally, the cap can also serve as a decorative ornament such as a hat, hair piece, or helmet for a figure included on or integral with the targeting orifice. As yet another embodiment, a cap can be configured to cover a bent over riser having a bobble-head figure so that, when removed, the bobble-head figure springs up like a jack in the box.

FIG. 7 illustrates another bottle adapter 700 in accordance with an alternate embodiment of the invention. The bottle adapter is suitable for use with a squeezable drink container 702 which has a valve 704, wherein the valve has the property that the valve remains closed until a predefined pressure difference is present across the valve. The bottle adapter includes a coupler 706 configured for attachment to the squeezable drink container. A targeting orifice 708 is mechanically coupled to the coupler and positionable at a predefined distance 716 from the valve. The predefined distance is selected so that, when the squeezable drink container is squeezed, the trajectory of liquid stream emerging from the valve extends through the targeting orifice substantially independently of the orientation of the squeezable drink container.

Various ways of attaching the coupler 706 to the squeezable drink container 702 are possible. The coupler can be permanently or removably attached to the squeezable drink container. For example, the coupler can include a horse-shoe shaped section 708 arranged to grasp the squeezable drink container. As another example, the coupler can include a ring 710 sized to fit snugly around the squeezable drink container. Either the horse-shoe shaped section or the ring arrangement allow the coupler to be slid onto the drink container and adjusted in height, sliding the bottle adapter 700 in a vertical direction 712.

Figure 8:
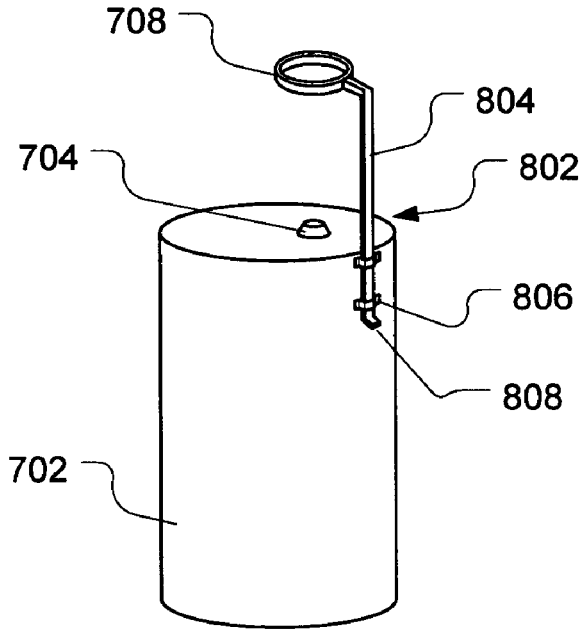
FIG. 8 is a perspective view of a bottle adapter attached to a squeezable drink container in accordance with another embodiment of the present invention.

As will be appreciated, the coupler 706 just illustrated can also be rotated around the squeezable drink container 702 in direction 714. This may prove undesirable if the valve 704 is offset from the center of the squeezable drink container (for example as shown in FIG. 8). Accordingly, the coupler and/or squeezable drink container can include indexing features, including for example, tabs or slots, to help ensure the proper orientation (both rotationally and/or vertically) of the targeting orifice 708 relative to the valve. Also, the squeezable drink container can also include one or more protrusions at the top and/or bottom edge to help avoid the coupler sliding past the end of the container. Such features are not illustrated as their implementation will be readily apparent to one of skill in the art.

An alternate arrangement of a coupler is shown in FIG. 8, in accordance with an embodiment of the present invention. The coupler 802 can include a riser 804, which is held in place by one or more hoops 806 attached to the squeezable drink container 702. This arrangement also allows the height of the riser to be adjusted. Optionally, the riser can include a tab 808 to help avoid the riser from being completely removed. As another option, the riser can include a tab as shown, or disposed in other locations, which can be grasped or pushed with a finger to adjust the riser up and down.

As yet another alternative, a coupler can be permanently attached to the squeezable drink container, for example, by making the coupler an integral part of the drink container, or by gluing, welding, or otherwise bonding the coupler to the squeezable drink container. Various ways of attaching the coupler to the squeezable drink container will occur to one of skill in the art in possession of this disclosure.

Figure 9:
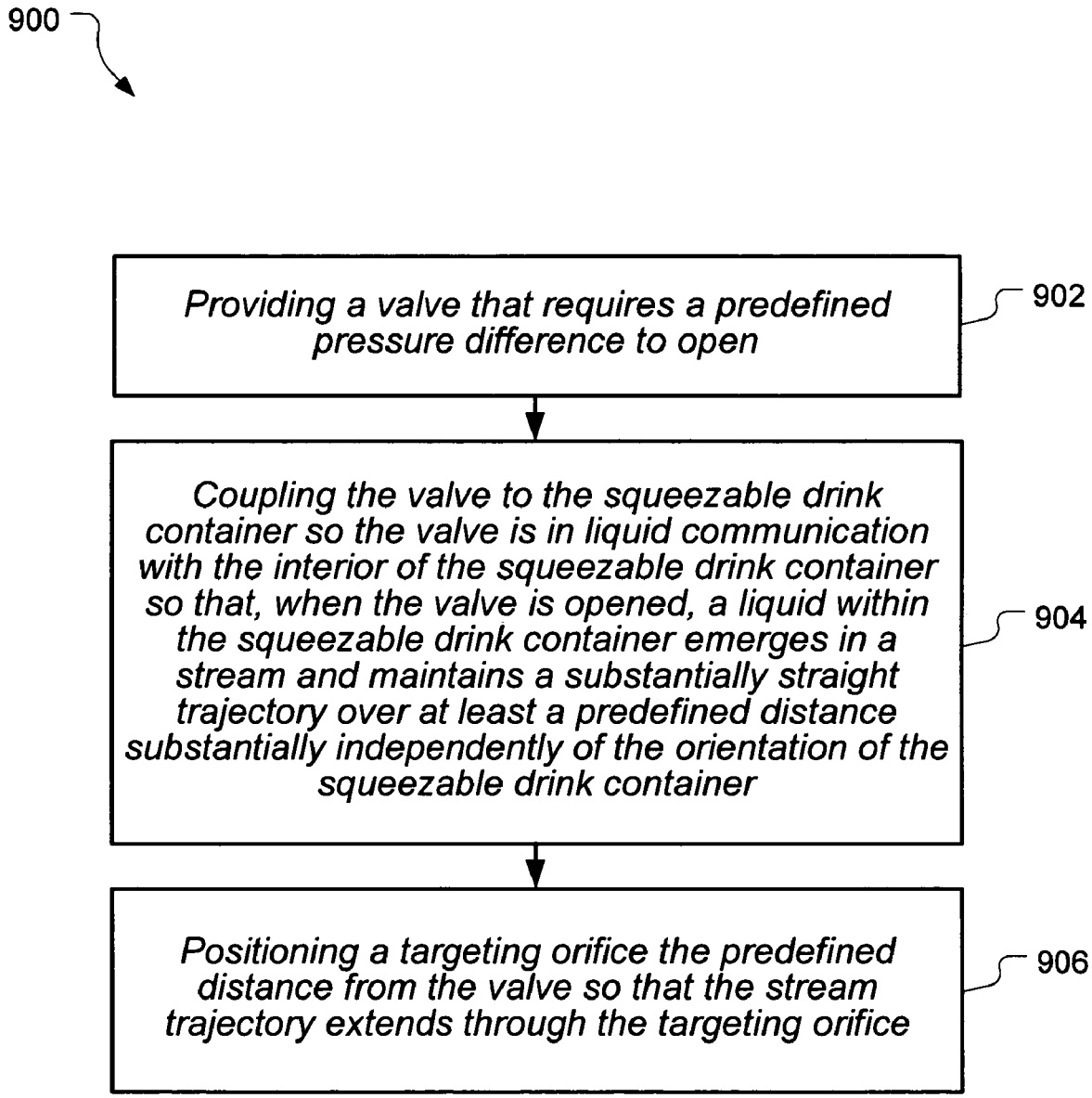
FIG. 9 is a flow chart of a method of accurate squirt dispensing of a drink from a squeezable drink container.

Finally, a method of accurate squirt dispensing of a drink from a squeezable drink container will now be described. FIG. 9 illustrates the method, shown generally at 900, in accordance with an embodiment of the present invention. A first step of the method is providing 902 a valve that requires a predefined pressure difference to open. For example, various suitable embodiments of valves are described above. Another step of the method is coupling 904 the valve to the squeezable drink container so the valve is in liquid communication with the interior of the squeezable drink container. When the valve is opened, a liquid within the squeezable drink container emerges in a stream and maintains a substantially straight trajectory over at least a predefined distance substantially independently of the orientation of the squeezable drink container. Another step of the method is spatially positioning 906 a targeting orifice the predefined distance from the valve so that the stream trajectory extends through the targeting orifice. For example, the targeting orifice may be positioned on a riser as described above. Techniques for coordinating the position of the targeting orifice and the characteristics of the valve are discussed above.

Optionally, the method 900 may further include the step of squeezing the squeezable drink container to cause a stream to emerge from the drink container whereby the stream extends through the targeting orifice.

Summarizing and reiterating to some extent, benefits of the present invention include an accurate squirt dispensing drink bottle adapter. Various embodiments of the bottle adapter are suitable for use with different types of squeezable drink containers. Improved accuracy is achieved by the combination of a targeting orifice which assists a user in properly positioning their mouth, and a valve which requires a predefined pressure difference before opening to help ensure that the stream extends through the targeting orifice. Open space between the valve and the targeting orifice adds visual interest and excitement during use of the bottle adapter. Various promotional and/or decorative features can be included to make use and/or distribution of the bottle adapter desirable.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A bottle adapter for accurate squirt dispensing of a drink comprising:

a coupler configured for removable attachment to a squeezable drink container;

a valve disposed within the coupler, the valve configured to remain closed until a predefined pressure difference is present across the valve so that when the valve is opened a liquid within the squeezable drink container emerges in a stream and maintains a substantially straight trajectory over at least a predefined distance; and a targeting orifice mechanically connected to the coupler and positionable at the predefined distance from the valve and oriented so the stream trajectory extends through the targeting orifice substantially independently of the orientation of the squeezable drink container, wherein the targeting orifice comprises a riser, wherein the riser is flexible, and wherein the targeting orifice comprises a first locking element, and the coupler comprises a second locking element configured for removable engagement with the first locking element to hold the riser in a collapsed position.

2. The bottle adapter of claim 1, wherein the coupler comprises internal threads for mating to a threaded top of the squeezable drink container.

3. The bottle adapter of claim 1, wherein the valve comprises a silicone slit valve.

4. The bottle adapter of claim 1, wherein the targeting orifice is glow in the dark.

5. The bottle adapter of claim 1, wherein the riser is retractable into the coupler.

6. The bottle adapter of claim 1, wherein the targeting orifice comprises a ring.

7. A bottle adapter for accurate squirt dispensing of a drink comprising:

a coupler configured for removable attachment to a squeezable drink container;

a valve disposed within the coupler, the valve configured to remain closed until a predefined pressure difference is present across the valve so that when the valve is opened a liquid within the squeezable drink container emerges in a stream and maintains a substantially straight trajectory over at least a predefined distance; and a targeting orifice mechanically connected to the coupler and positionable at the predefined distance from the valve and oriented so the stream trajectory extends through the targeting orifice substantially independently of the orientation of the squeezable drink container, wherein the targeting orifice comprises a riser, wherein the riser is flexible, and wherein the targeting orifice comprises a first locking element, and the riser comprises a second locking element configured for removable engagement with the first locking element to hold the riser in a collapsed position.

8. The bottle adapter of claim 7, wherein the coupler comprises internal threads for mating to a threaded top of the squeezable drink container.

9. The bottle adapter of claim 7, wherein the valve comprises a silicone slit valve.

10. The bottle adapter of claim 7, wherein the targeting orifice is glow in the dark.

11. The bottle adapter of claim 7, wherein the targeting orifice comprises a ring.

12. The bottle adapter of claim 7, wherein the riser is retractable into the coupler.

13. A bottle adapter for accurate squirt dispensing of a drink comprising:

a coupler configured for removable attachment to a squeezable drink container;

a valve disposed within the coupler, the valve configured to remain closed until a predefined pressure difference is present across the valve so that when the valve is opened a liquid within the squeezable drink container emerges in a stream and maintains a substantially straight trajectory over at least a predefined distance;

a targeting orifice mechanically connected to the coupler and positionable at the predefined distance from the valve and oriented so the stream trajectory extends through the targeting orifice substantially independently of the orientation of the squeezable drink container, wherein the targeting orifice comprises a riser, and wherein the targeting orifice further comprises an image and wherein the riser is flexible to provide a bobble head effect to the image; and a cap configured to engage with the coupler to hold the riser in a bent position so that when the cap is removed the riser springs up providing a jack in the box effect to the image.

14. The bottle adapter of claim 13, wherein the coupler comprises internal threads for mating to a threaded top of the squeezable drink container.

15. The bottle adapter of claim 13, wherein the valve comprises a silicone slit valve.

16. The bottle adapter of claim 13, wherein the targeting orifice is glow in the dark.

17. The bottle adapter of claim 13, wherein the targeting orifice comprises a ring.

18. The bottle adapter of claim 13, wherein the riser is retractable into the coupler.

19. A bottle adapter for accurate squirt dispensing of a drink comprising:

a coupler configured for removable attachment to a squeezable drink container;

a valve disposed within the coupler, the valve configured to remain closed until a predefined pressure difference is present across the valve so that when the valve is opened a liquid within the squeezable drink container emerges in a stream and maintains a substantially straight trajectory over at least a predefined distance;

a riser mechanically connected to the coupler and retractable into the coupler;

a targeting orifice mechanically connected to the riser and positionable at the predefined distance from the valve and oriented so the stream trajectory extends through the targeting orifice substantially independently of the orientation of the squeezable drink container.

20. The bottle adapter of claim 19, wherein the coupler comprises internal threads for mating to a threaded top of the squeezable drink container.

21. The bottle adapter of claim 19, wherein the valve comprises a silicone slit valve.

22. The bottle adapter of claim 19, wherein the targeting orifice is glow in the dark.

23. The bottle adapter of claim 19, wherein the targeting orifice comprises a ring.

* * * * *